US006758355B2

(12) United States Patent
Zidek

(10) Patent No.: US 6,758,355 B2
(45) **Date of Patent: *Jul. 6, 2004**

(54) DISPLAY RACK WITH REPOSITIONABLE SHELF

(75) Inventor: Richard L. Zidek, Chicago, IL (US)

(73) Assignee: Astoria Wire Products, Inc., Bedford Parks, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/427,853

(22) Filed: May 1, 2003

(65) Prior Publication Data

US 2003/0192848 A1 Oct. 16, 2003

Related U.S. Application Data

(63) Continuation of application No. 09/896,683, filed on Jun. 29, 2001, now Pat. No. 6,575,315.

(51) Int. Cl.[7] ..... A47B 47/00

(52) U.S. Cl. ..... 211/205; 211/90.03; 211/106; 211/175

(58) Field of Search ..... 211/181.1, 90.03, 211/106, 205, 204, 90.04, 193, 208, 119.003, 94.01, 196, 175, 90.01, 90.02; 108/102, 105–108, 147.11; 248/224.61, 124.61, 124.2, 121, 153, 158, 175, 200.1, 215, 218.4, 219.3, 222.52, 225.21, 298.1, 302–304, 338

(56) References Cited

U.S. PATENT DOCUMENTS

| | | | |
|---|---|---|---|
| 136,722 | A | 3/1873 | Hogue |
| 1,282,557 | A | 10/1918 | Feldtkeller |
| 1,421,614 | A | 7/1922 | Taubman |
| 1,981,569 | A | 11/1934 | Pope |
| 2,254,770 | A | 9/1941 | Bitney |
| D136,722 | S | 11/1943 | Waterman |
| 2,529,649 | A | 11/1950 | Coplen |
| 2,598,529 | A | 5/1952 | Fritz |
| 2,706,563 | A | 4/1955 | Larson |
| 2,941,772 | A | 6/1960 | Thayer et al. |
| 3,031,088 | A | 4/1962 | Ribbens et al. |
| 3,043,440 | A | 7/1962 | Berlin |
| 3,067,882 | A | 12/1962 | Ribbens et al. |
| 3,146,732 | A | 9/1964 | Tozier |
| 3,252,614 | A | 5/1966 | Evans |
| 3,381,636 | A | 5/1968 | Saiberlich |
| 3,420,480 | A | 1/1969 | Matson |
| 3,424,313 | A | 1/1969 | Fiebelman |
| 3,508,666 | A | 4/1970 | Schwengel |
| 3,669,035 | A | 6/1972 | Grossman |

(List continued on next page.)

FOREIGN PATENT DOCUMENTS

| | | |
|---|---|---|
| AU | 209327 | 7/1955 |
| DK | 74107 | 5/1952 |
| FR | 1.333.926 | 6/1963 |
| GB | 1 325 708 | 5/1971 |

*Primary Examiner*—Jennifer E. Novosad
(74) *Attorney, Agent, or Firm*—Brinks Hofer Gilson & Lione

(57) ABSTRACT

A display rack includes an upright that supports a crosspiece and one or more shelves. Each shelf includes two clips, and each clip includes a lip element configured to fit over and to engage an upper surface of the crosspiece, and a spring element configured to snap-lock against a lower, opposed of the crosspiece. The first and second clips are positioned on the shelf such as the shelf is mountable on the crosspiece in three different positions: a first position, in which each clip is disposed on a respective side of the upright; a second position, in which both clips are disposed on a first side of the upright; and a third position, in which both clips are disposed on the other side of the upright.

13 Claims, 3 Drawing Sheets

U.S. PATENT DOCUMENTS 3,679,066 A 7/1972 Leffeld
3,705,654 A 12/1972 Barrineau, III
3,907,119 A 9/1975 Franz
3,915,097 A 10/1975 Young, Jr.
3,915,308 A 10/1975 Ratzloff et al.
3,923,277 A 12/1975 Perrault et al.
4,106,736 A 8/1978 Becker, III et al.
4,292,902 A 10/1981 Barrineau
4,340,144 A 7/1982 Cousins
4,391,378 A * 7/1983 Secon ..... 211/187
4,716,841 A 1/1988 Suttles
4,762,238 A 8/1988 Blanchard
4,778,066 A 10/1988 Stjernberg
4,795,039 A 1/1989 Thornborrow
4,842,230 A 6/1989 Cobb et al.
4,863,126 A 9/1989 Rogers
4,865,283 A 9/1989 Parker
4,884,702 A 12/1989 Rekow
5,031,783 A 7/1991 Goudreau
5,272,991 A 12/1993 Carrigan, Jr.
5,482,168 A 1/1996 Welch et al.
5,490,599 A 2/1996 Tohidi
5,588,543 A 12/1996 Finger
5,732,833 A 3/1998 Alvarado et al.
5,735,413 A 4/1998 Allen
5,769,248 A 6/1998 Johnson
5,788,093 A 8/1998 Krut
5,794,795 A 8/1998 Stemmons
5,855,283 A 1/1999 Johnson
5,855,286 A 1/1999 Zaid
5,871,115 A 2/1999 Kohn
5,887,731 A 3/1999 Thalenfeld
5,996,812 A * 12/1999 Sokol, Jr. ..... 211/11
6,070,747 A 6/2000 Shea
6,089,387 A 7/2000 Varfolomeeva
6,234,330 B1 5/2001 Gray
6,299,001 B1 10/2001 Frolov et al.
6,308,842 B1 10/2001 Robbins, et al.
6,575,315 B2 * 6/2003 Zidek ..... 211/205

* cited by examiner

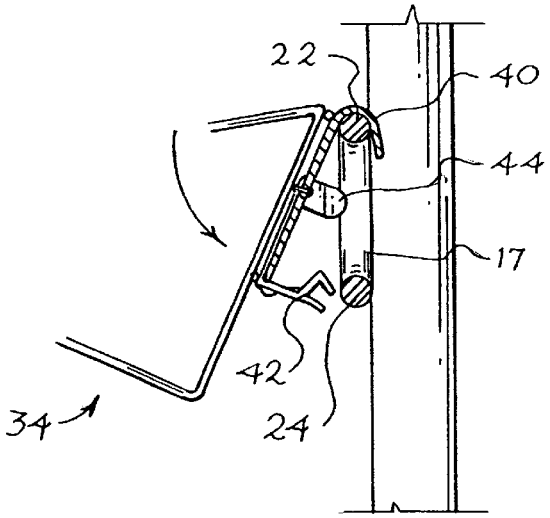
Fig. 5
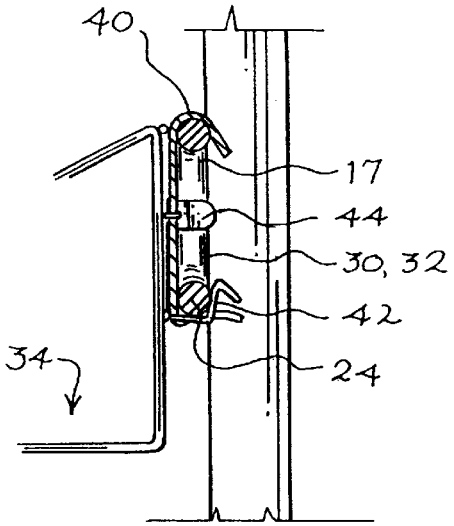
Fig. 6
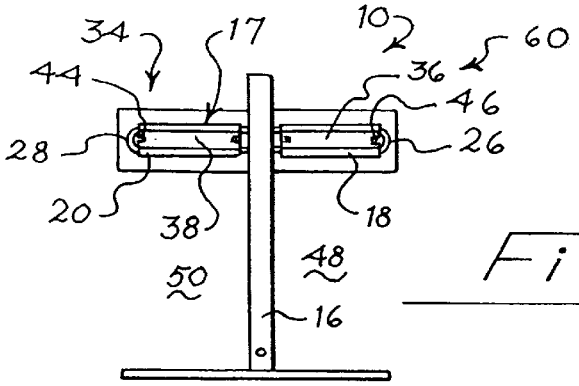
Fig. 7
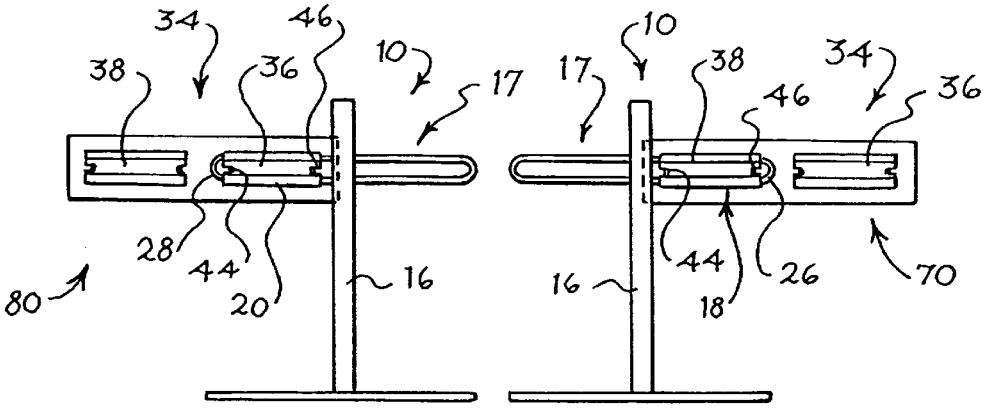
Fig. 9
Fig. 8

DISPLAY RACK WITH REPOSITIONABLE SHELF

This application is a continuation of U.S. patent application Ser. No. 09/896,683, filed Jun. 29, 2001, now U.S. Pat. No. 6,575,315, the entire disclosure of which is incorporated herein by reference.

BACKGROUND

The present invention relates to display racks, and in particular to display racks that can be assembled in multiple configurations in a simple and reliable manner.

Carrigan U.S. Pat. No. 5,272,991 discloses a display rack in which wire shelves are mounted in place on horizontally extending bars. In the disclosed display rack, each of the bars defines a constant cross section, and each of the shelves includes a C-channel shaped to receive one of the bars. The shelves are assembled onto respective bars by telescopically sliding them into position from one end of the bar. As shown on the front page of the Carrigan patent, the shelves can be positioned in any of various positions with respect to the bar.

The sliding action used to install the shelves on the bar in the Carrigan patent requires a shelf to be moved horizontally beyond the end of the bar in order to remove the shelf from the bar. This may not be convenient in all applications.

SUMMARY

By way of general introduction, the preferred embodiment described below includes at least one shelf that has first and second clips. Each clip has an upper lip element configured to fit over and engage an upper side of a crosspiece, and a spring element configured to snap-lock against a lower, opposed side of the crosspiece. The shelf can be mounted on the crosspiece in any one of three positions: a first position, in which the two clips are disposed on opposite sides of an upright that supports the crosspiece; a second position, in which both of the clips are disposed on a first side of the upright; and a third position, in which both of the clips are disposed on a second side of the upright.

This display rack provides a simple and effective arrangement for adjustably mounting the shelf in any one of the three desired positions on the crosspiece.

This section has been provided by way of general introduction, and it should not be used to narrow the scope of the following claims.

BRIEF DESCRIPTION OF THE DRAWINGS

FIGS. 5 and 6 are fragmentary side sectional views of the shelf of FIG. 1 during installation (FIG. 5) and after installation has been completed (FIG. 6) on the crosspiece of FIG. 1.

FIGS. 7, 8 and 9 are schematic rear elevational views showing the shelf of FIG. 1 mounted to the crosspiece of FIG. 1 in first, second and third positions, respectively.

DETAILED DESCRIPTION OF THE PRESENTLY PREFERRED EMBODIMENTS

Figure 1:
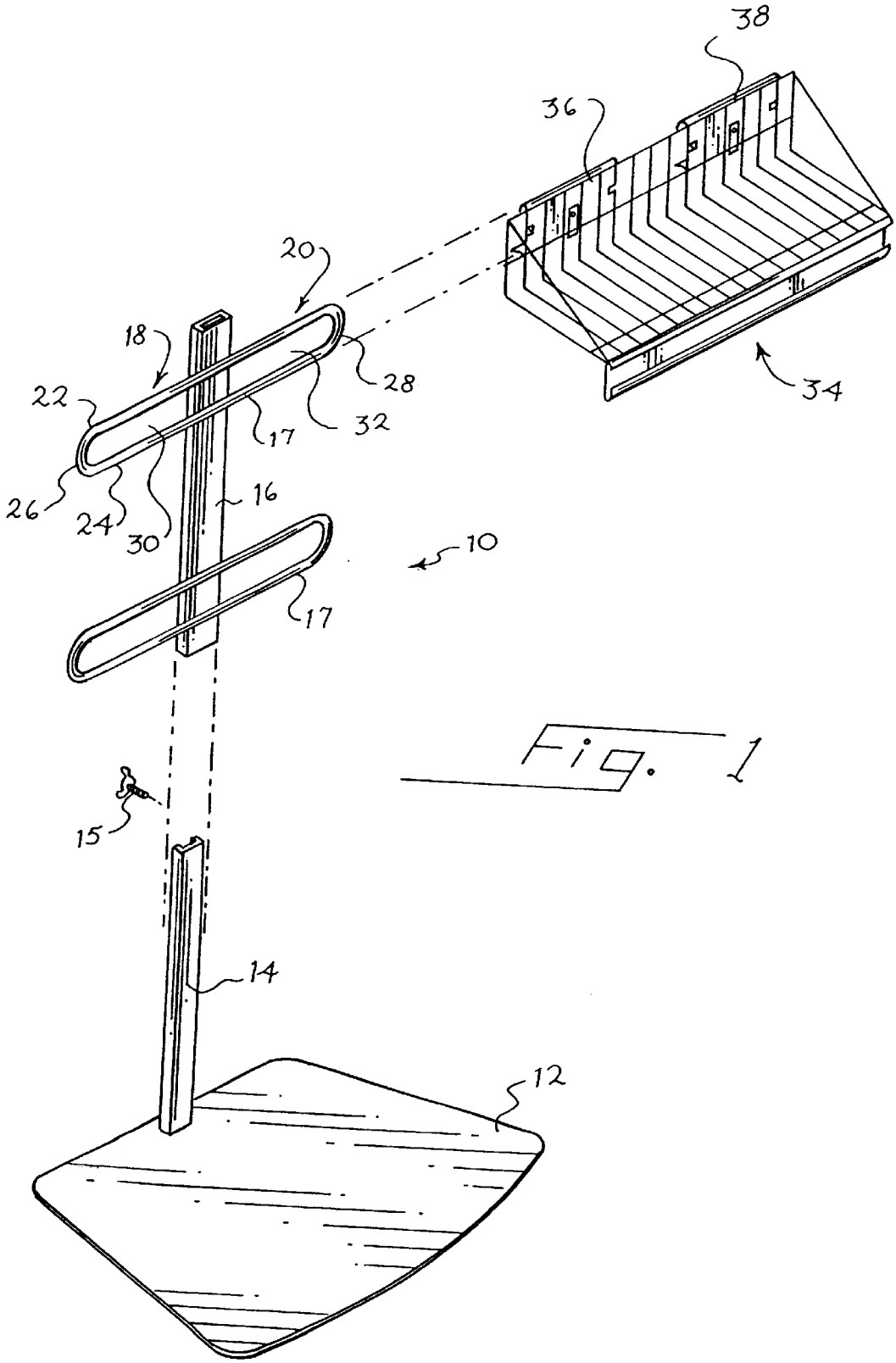
FIG. 1 is an exploded perspective view of a display rack that incorporates a preferred embodiment of this invention.

Turning now to the drawings, FIG. 1 shows an exploded perspective view of a display rack 10. The view of FIG. 1 shows only a single shelf 34, though in actual practice more than one shelf 34 is typically used.

The display rack 10 includes a base 12 that supports a vertically extending post 14. For example, the base 12 can be formed as a metal plate, and the post 14 can be formed as a rigid C-channel that is welded in place to the base 12.

An upright 16 is releasably secured to the post 14. For example, the upright 16 can be formed as a box channel that telescopically receives the post 14. A threaded fastener such as a thumb screw 15 can be threaded to the upright 16 to secure the upright 16 releasably in place on the post 14. This arrangement allows the user to adjust the height of the upright 16 relative to the base 12.

The upright 16 supports one or more crosspieces 17. In this example, each of the crosspieces 17 includes a respective wire loop having first and second parts 18, 20 on respective sides of the upright 16. The crosspiece 17 defines an upper side 22 and a lower side 24, and each of the parts 18, 20 includes a respective end portion 26, 28. The wire loop of the first part 18 bounds a space 30, and the wire loop of the second part 20 bounds a space 32.

The display rack 10 also includes one or more shelves 34, and each of the shelves 34 includes first and second clips 36, 38 disposed in side-by-side relationship on a rear portion of the shelf 34.

Figure 2:
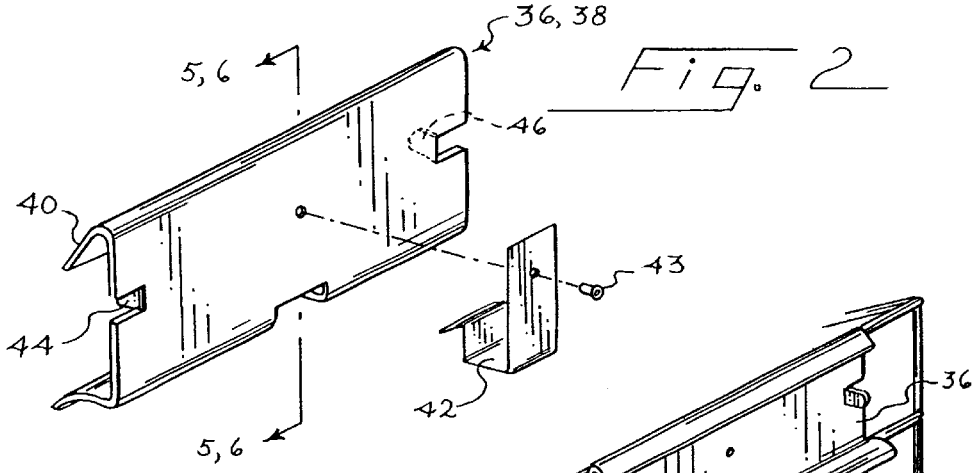
FIG. 2 is an exploded perspective view of one of two clips mounted to the back of the shelf of FIG. 1.

FIG. 2 provides an exploded perspective view of one of the clips 36, 38. As shown in FIG. 2, each clip includes an upper lip element 40 and a lower spring element 42. In this example, the lip element 40 is formed as part of a C-channel, and the spring element 42 is secured to the C-channel, as for example with a rivet 43. Tabs 44, 46 are bent out of the plane of the clips 36, 38, such that the tabs 44, 46 extend away from the shelf 34 of FIG. 1.

Figure 3:
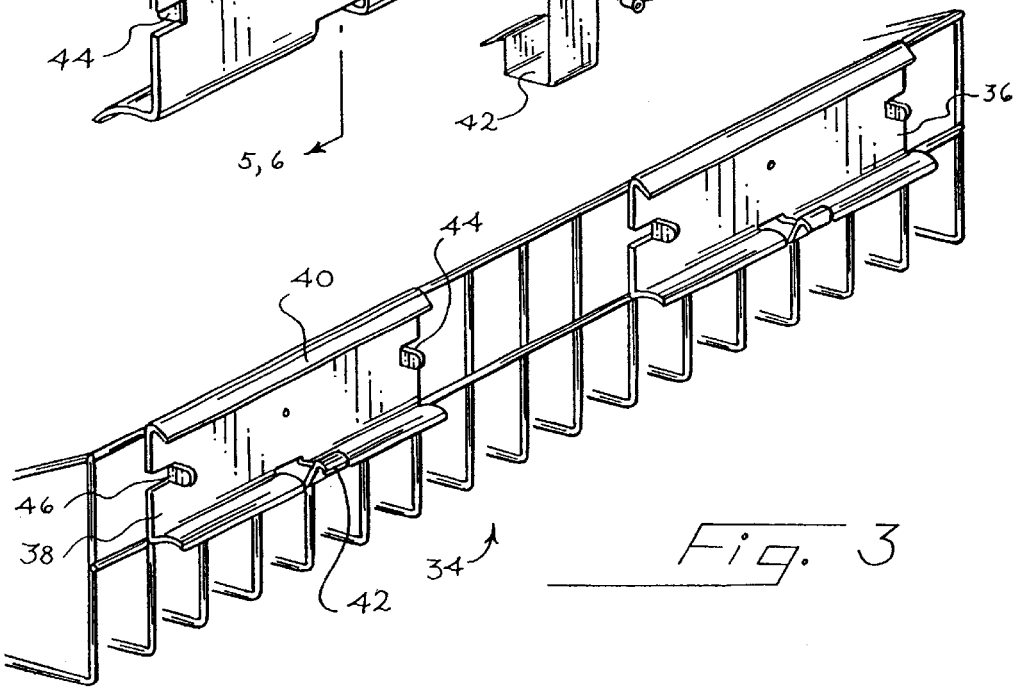
FIG. 3 is a fragmentary rear perspective view of the shelf of FIG. 1.
Figure 4:
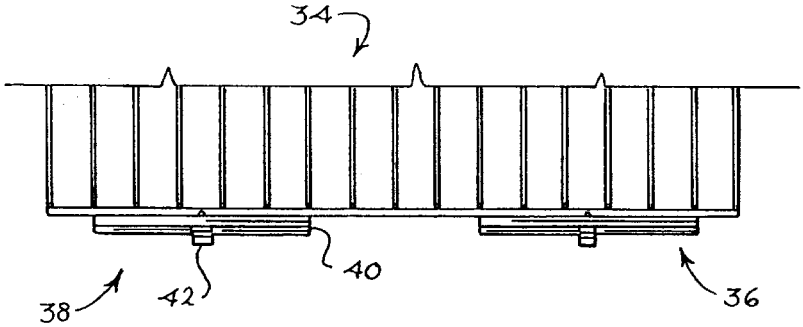
FIG. 4 is a fragmentary top plan view of the shelf of FIG. 1.

FIGS. 3 and 4 provide rear and top views, respectively, showing the relationship between the various elements of the clips 36, 38 and the shelf 34.

FIGS. 5 and 6 show two steps in installing or removing the shelf 34 from the crosspiece 17, as viewed from the side. As shown in FIG. 5, the lip element 40 is first placed over the upper side 22 of the crosspiece 17, with the shelf 34 angled upwardly. In this position the spring element 42 is disposed forwardly of the lower side 24 of the crosspiece 17. Next, the shelf 34 is rotated about the lip element 40 from the position of FIG. 5 to that of FIG. 6. In this position, the spring element 42 fits around and snap-locks against the lower side 24 of the crosspiece 17. The tabs 44, 46 (only tab 44 is shown in FIGS. 5 and 6) fit into one of the spaces 30, 32 bounded by the crosspiece 17.

When it is desired to remove the shelf 34 from the crosspiece 17, the spring element 42 is moved downwardly from the position shown in FIG. 6, thereby releasing the shelf 34 for rotation about the lip element 40 to the position of FIG. 5, where it can be lifted and removed from the crosspiece 17.

FIGS. 7, 8 and 9 show three alternative positions in which the shelf 34 can be mounted on the crosspiece 17. FIGS. 7–9 show the display rack 10 from the rear, and side-specific reference numerals are therefore reversed in FIGS. 7–9 as compared with FIG. 1.

In the first shelf position 60 shown in FIG. 7, the shelf 34 is positioned with the clips 36, 38 on respective sides 48, 50 of the upright 16. In this position the first and second clips 36, 38 are secured to the first and second parts 18, 20 of the crosspiece 17, respectively. Tab 44 of the clip 38 is positioned to mechanically interfere with the end 28, thereby preventing any sliding movement of the shelf 34 to the left as shown in FIG. 7. Similarly, the tab 46 of the first clip 36 is positioned to mechanically interfere with the first end 26, thereby preventing any substantial sliding movement of the shelf 34 to the right, as shown in FIG. 7.

FIG. 8 shows the shelf 34 mounted in a second position 70 on the crosspiece 17. In this second position, the second clip 38 is snap-latched in place on the first part 18 of the crosspiece 17. Tab 46 of the second clip 38 mechanically interferes with the first end portion 26, thereby preventing any substantial sliding movement of the shelf 34 to the right, as shown in FIG. 8. The tab 44 of the second clip 38 or another structural part of the second clip 38 mechanically interferes with the upright 16 to prevent any substantial sliding movement of the shelf 34 to the left in the view of FIG. 8. Note that in this example, the first clip 36 is not engaged with the crosspiece 17, and the right-hand portion of the shelf 34 is cantilevered beyond the crosspiece 17 in the view of FIG. 8.

FIG. 9 shows the shelf 34 mounted in a third position 80, in which the first clip 36 is snap-locked to the second part 20 of the crosspiece 17. In this third position the second clip 38 is not engaged with the crosspiece 17, and the left-hand portion of the shelf 34 is cantilevered beyond the crosspiece 17 in the view of FIG. 9. The tab 44 of the first clip 36 mechanically interferes with the second end portion 28, thereby preventing any substantial sliding movement of the shelf 34 to the left in the view of FIG. 9. The tab 46 or some other portion of the first clip 36 mechanically interferes with the upright 16 to prevent any substantial sliding movement of the shelf 34 to the right in the view of FIG. 9.

It should be apparent from the foregoing description that the display rack 10 can easily be assembled and disassembled with the shelf 34 in any one of the first, second, and third positions 60, 70, 80. The tabs 44, 46 or other parts of the clips 36, 38 prevent any substantial undesired sliding movement of the shelf 34 along the crosspiece 17 in all three positions. A simple rotational movement is all that is required to latch shelf 34 in position on the crosspiece 17 and to remove the shelf 34 from the crosspiece 17, and all cumbersome telescoping sliding movements are eliminated.

Of course, many changes and modifications can be made to the preferred embodiment described above. For example, the upright 16 can take any desired structural form, and can be formed as a plate, a rod, a C-channel, or another shape in an alternative embodiment. The base 12 can be formed as a plate or a wire frame, or alternatively the base can include a socket or a post intended to receive a mating structure. The crosspiece 17 can be formed in one or more parts using any suitable structural element. For example, the crosspiece can be formed as a plate or a channel. The clips 36, 38 may be formed from multiple parts that are separately mounted to the shelf. For example, the lip elements 40, spring elements 42, and tabs 44, 46 can all be separately mounted to the shelf 34, without intermediate structures such as that provided by the illustrated channel. Alternatively, the clips 36, 38 may correspond to laterally-spaced portions of a single structural element such as a plate or a channel. The shelf 34 can be a wire shelf as illustrated, or it can include solid or apertured plates. The shelf may or may not have raised walls and a raised back.

Materials can be varied widely, depending on the application, though C-1050 (annealed, tensile 74200) spring steel for the spring clip and cold-rolled mild steel for the remaining elements have been found suitable.

As used herein the term "set" is intended broadly to encompass one or more elements.

The foregoing detailed description has discussed only a few of the many forms that this invention can take. This detailed description is therefore intended by way of illustration and not limitation. It is only the following claims, including all equivalents, that are intended to define the scope of this invention.

What is claimed is:

1. A display rack comprising:

a base;

at least one upright secured to the base;

at least one crosspiece secured to the at least one upright, said at least one crosspiece comprising a first cantilevered part extending on a first side of the at least one upright and having a first unsupported free end and a second cantilevered part extending on a second, opposed side of the at least one upright and having a second unsupported free end;

at least one shelf comprising first and second clips, each clip comprising a respective lip element configured to fit over and to engage a first side of the at least one crosspiece, and a respective spring element configured to snap-lock against a second, opposed side of the at least one crosspiece;

said first and second clips positioned on the at least one shelf such that the at least one shelf is mountable on the at least one crosspiece in each of three positions:

a first position, in which both spring elements are snap-locked against the at least one crosspiece with the first clip disposed on the first side of the at least one upright and snap-locked against the first cantilevered part and the second clip disposed on the second side of the at least one upright and snap-locked against the second cantilevered part;

a second position, in which at least the second spring element is snap-locked against the first cantilevered part of the at least one crosspiece with both the first and second clips disposed on the first side of the at least one upright; and a third position, in which at least the first spring element is snap-locked against the second cantilevered part of the at least one crosspiece with both the first and second clips on the second side of the at least one upright.

2. The display rack of claim 1 wherein said respective lip elements and said respective spring elements of each of said first and second clips are vertically aligned.

3. The display rack of claim 1 wherein said at least one crosspiece comprises a wire loop forming an upper and lower horizontal member on each of said first and second sides of the at least one upright, wherein said upper horizontal member is positioned above said lower horizontal member, and wherein each said respective lip element is configured to fit over and engage one of said upper and lower horizontal members and each said respective spring element is configured to snap-lock against the other of said upper and lower horizontal members.

4. The display rack of claim 3 wherein first and second unsupported free ends are curved between said upper and lower horizontal members on each of said first and second sides of the at least one upright.

5. The display rack of claim 3 wherein each of said clips comprises at least one tab protruding into a space bounded by said wire loop, the at least one tab positioned to mechanically interfere with the wire loop when the at least one shelf is mounted on the at least one crosspiece in at least one of the first, second and third positions, thereby limiting sliding movement of the at least one shelf along the at least one crosspiece away from the at least one upright.

6. The display rack of claim 1 wherein said at least one shelf has a first length and said at least one crosspiece has a second length, wherein said first length is greater than said second length.

7. A display rack comprising:

a base;

at least one upright secured to the base;

at least one crosspiece secured to the at least one upright and having at least a first portion extending on a first side of the at least one upright and at least a second portion extending from an opposite second side of the at least one upright, the at least said first and second portions of said at least one crosspiece each comprising an upper and lower horizontal member defining a plane and joined by a curved end portion, wherein said upper horizontal members are positioned above said lower horizontal members, and wherein said curved end portions are each curved within said respective plane;

at least one shelf comprising a first element configured to fit over and to engage one of said upper and lower horizontal members of a selected one of the first and second portions of the at least one crosspiece, and a second element configured to fit over and engage the other of said upper and lower horizontal members of the selected one of the first and second portions of the at least one crosspiece.

8. The display rack of claim 7 wherein said upper and lower horizontal members and said curved end portion of said first portion are integrally formed from a single piece of material.

9. The display rack of claim 8 wherein said upper and lower horizontal members and said curved end portion of said second portion are integrally formed with said first portion from said single piece of material.

10. The display rack of claim 7 wherein said at least one shelf comprises first and second clips, each clip comprising one each of said first and second elements;

said first and second clips positioned on the at least one shelf such that the at least one shelf is mountable on the at least one crosspiece in each of three positions:

a first position, in which both of said second elements are snap-locked against the at least one crosspiece with the first clip disposed on a first side of the at least one upright and snap-locked against the first portion and the second clip disposed on the second side of the at least one upright and snap-locked against the second portion;

a second position, in which at least one of the second elements is snap-locked against the first portion of the at least one crosspiece with both the first and second clips disposed on the first side of the at least one upright; and a third position, in which at least one of the second elements is snap-locked against the second portion of the at least one crosspiece with both the first and second clips disposed on the second side of the at least one upright.

11. The display rack of claim 7 wherein said at least one shelf comprises at least one tab protruding into a space bounded by at least one of said first and second portions of said at least one crosspiece, said at least one tab positioned to mechanically interfere with the at least one first and second portion when the at least one shelf is mounted on the at least one crosspiece in at least one of the first, second and third positions, thereby limiting sliding movement of the at least one shelf along the at least one crosspiece away from the at least one upright.

12. The display rack of claim 7 wherein said first and second elements are vertically aligned.

13. A display rack comprising:

a base;

at least one upright secured to the base;

at least one crosspiece secured to the at least one upright and having at least a first portion extending on a first side of the at least one upright and at least a second portion extending from an opposite second side of the at least one upright, the at least said first and second portions of said at least one crosspiece each comprising an upper and lower horizontal member, wherein said upper horizontal members are positioned above said lower horizontal members; and at least one shelf comprising a first element configured to fit over and to engage one of said upper and lower horizontal members of a selected one of first and second portions of the at least one crosspiece, and a second element configured to fit over and engage the other of said upper and lower horizontal members of the selected one of the first and second portions of the of the at least one crosspiece;

wherein said at least one shelf has a first length and said at least one crosspiece has a second length, wherein said first length is greater than said second length.

* * * * *